United States Patent [19]

Bister et al.

[11] 4,167,902

[45] Sep. 18, 1979

[54] BALING PRESS WITH BALE BINDING DEVICE AND OPERATION THEREOF

[75] Inventors: Eugen Bister; Günter Bohne, both of Düsseldorf; Karl H. Melmert, Hilden; Kurt Pessel, Düsseldorf; Reiner Riepe, Ratingen, all of Fed. Rep. of Germany

[73] Assignee: Lindemann Maschinenfabrik GmbH, Düsseldorf, Fed. Rep. of Germany

[21] Appl. No.: 887,840

[22] Filed: Mar. 17, 1978

[30] Foreign Application Priority Data

Mar. 26, 1977 [DE] Fed. Rep. of Germany ..... 2713412

[51] Int. Cl.[2] ..... B65B 13/02

[52] U.S. Cl. ..... 100/3; 100/11; 100/31

[58] Field of Search ..... 100/3, 11, 18, 19, 20, 100/21, 22, 23, 24, 31

[56] References Cited

U.S. PATENT DOCUMENTS

| | | | |
|---|---|---|---|
| 2,585,425 | 2/1952 | Baskerville | 100/31 X |
| 3,667,377 | 6/1972 | Persson | 100/31 X |

FOREIGN PATENT DOCUMENTS

| | | | |
|---|---|---|---|
| 2419151 | 11/1975 | Fed. Rep. of Germany | 100/31 |

*Primary Examiner*—Billy J. Wilhite

*Attorney, Agent, or Firm*—Toren, McGeady and Stanger

[57] ABSTRACT

A baling press of the kind comprising a pressing channel containing a reciprocating pressing plunger has a bale binding device which binds the bales with bands each consisting of two separate lengths of wire from different rolls twisted together. The binding device includes a twisting mechanism for twisting the wires together and this twisting device comprises a disc which is rotatable about an axis situated in the plane of the binding and this disc has a single finger which projects outwards from the axis of rotation of the disc and is forwardly curved in the direction of rotation of the disc in order to seize the two wires and twist them together. The inner edge of the finger leads into a slit which extends through the disc up to the center of rotation of the disc and this slit tapers in a region adjacent the center of rotation of the disc to a width which only just exceeds the thickness of one wire. The binding device is operated in such a way that during the last turn of the disc at the end of a twisting operation, a needle which draws a loop from one of the wires is moved towards the disc so that the subsequent rotation of the disc at the end of its last turn swings the loop out of the path of the needle before the disc is brought to a standstill.

3 Claims, 8 Drawing Figures

BALING PRESS WITH BALE BINDING DEVICE AND OPERATION THEREOF

This invention relates to baling presses comprising a pressing channel, means for feeding material to be baled to the channel, a pressing plunger which is reciprocable in the channel to form a succession of pressed bales in the channel and a device for binding the bales formed in the channel. It is particularly concerned with such presses in which the binding device comprises holders for holding two separate rolls of binding wire, a twisting mechanism for connecting the wires to each other, a binding needle, means for moving the needle across the channel to form a loop of one wire in a position in which, in use, the first wire, together with the second wire, forms a band surrounding a bale in the pressing channel, and a cutting device which, in use, cuts the wires in between two positions in which they are connected together by the twisting mechanism. The invention also relates to methods of operating the binding devices of such presses.

The above-described form of binding device, which is disclosed in German Offenlegungsschrift No. 2,253,160 comprises, for twisting the wires, a disc, which operates with two fingers projecting from the disc approximately radially for the purpose of pulling in the wires to be twisted together. The wires are held under tension adjacent to the disc at a specific distance from each other and from the disc. The fingers are of different lengths and the shorter finger, which is in front of the other finger in the direction of rotation of the disc, has the function of seizing the wire nearest to the disc, and the longer finger has the function of seizing the wire furthest from the disc and of conducting both the wires into associated slits in the disc. Of the two wires to be twisted together, the wire associated with the shorter finger comes directly from a storage roll situated on the side of the channel adjacent the twisting device, whereas the wire which is seized by the longer finger is brought as a loop by the binding needle from a storage roll situated on the opposite side of the channel.

During the forming of the loop by means of the binding needle, it is absolutely essential for the disc carrying the fingers to be stationary in the position shown in FIG. 3 of the drawings of the Offenlegungsschrift. This is necessary to prevent a collision with the binding needle and/or the wires to be twisted. Therefore, the disc must, after the previous twisting operation has been completed, be stopped in a position which must be maintained very accurately. This can only be achieved if an electric motor driving the disc is stopped by cam discs and/or by limit switches in dependence upon the number of revolutions executed by the disc, or by a timing relay. This is, however, technically very difficult, since braking devices are subjected to wear and then operate inaccurately and timing relays also have too large a switching tolerance for the present case, so that the range of stopping positions of the disc is too great. In practice in operating of this known form of binding device, therefore, it frequently occurs that, after a twisting operation has been completed, one of the fingers, usually the shorter finger, stops in the critical collision region, so that the length of wire associated with this finger is then drawn by means of the binding needle along the back of this finger which has already rotated too far. The consequence of this is that the wire associated with the shorter finger is subsequently seized not by this finger, but is seized together with the other wire by the longer finger.

From FIG. 3 of the drawings of Offenlegungsschrift No. 2,253,160 it can be seen that the slits in the disc which receive the wires are considerably wider than the thickness of the wires. Indeed this is to be expected in view of the manner in which the device operates. As a result, it can occur in the above-described, undesired operating condition, that the two wires which have both entered the same slit in the disc are not twisted together because they cannot be held firmly in the slit, but simply turn in the slit as the disc rotates without appreciably changing their relative positions. Since the discs of a number of binding devices for forming a number of bindings side by side round the bale are driven synchronously, this disadvantage arises equally in all the planes of all the bindings, so that an effectively unbound and thus useless bale is produced. This must be removed from the press with considerable loss of time and output. The above-described disadvantage can also occur with the known binding device if the wires to be seized by the fingers, due to distortions in the wires produced by residual strains in the wires do not adopt exactly the positions required by the construction of the baling press and binding device.

Further disadvantages of the known device arise from the fact that the twisting together of the two wires cannot take place at the centre of the disc, since the wires are held apart from one another in the two different slits in the disc and only converge on both sides of the disc. This has the disadvantage that the twisting commences, not simultaneously along the entire length of the wires to be twisted together, but initially at the positions furthest from the disc. Starting from these positions, a very flat, loose twist is initially produced. The twist then becomes steeper and tighter towards the disc, because the angles which the wires make with the surface of the disc become more acute the closer the twist approaches the disc. During the last third of the twisting operation, the twist as it approaches the disc thus changes into a torsional movement of the wires which does not move along the length of the wires. Such a torsional loading frequently exceeds the strength limits of the wire, so that wire breakages near to the disc are not infrequent either during the twisting operation or during the subsequent transporting of the bale.

The prising apart of the wires in the region of the disc also has an undesirable aspect in that it causes the wire ends to project from the twist positions on the finished, bound bales, and this leads to an increased risk of injury of persons handling the bales.

In presses in which the known device operates with a binding needle which draws the wire loop upwards from below, the mode of operation according to which the wire loop is held in the binding needle until after twisting and cutting of the wire between the twist positions and is only then removed from the binding needle, is moreover complicated and not reliable. This is mainly because the binding needle, after the twisting together and cutting of the wire between the twist positions, is lowered until the wire loop is situated above the barb or hook of the needle and is then removed from the binding needle by the forward movement of the next bale being formed in the channel so that the binding needle cannot be withdrawn until after the next bale has been partly formed by a few strokes of the pressing plunger. Here again it can happen that the wire loop is not released from the hook of the binding needle due to distortion of the wire, with the result that as the pressing operation of the next bale proceeds bending of the needle can occur.

The aim of the present invention is to provide a binding device in a baling press as described above and also to provide a method of operating the device, which do not suffer from the aforementioned disadvantages and are distinguished by a considerably simpler construction and more reliable mode of operation than the device disclosed in the above-mentioned Offenlegungsschrift.

To this end, according to this invention, in such a baling press provided with a binding device as described above, the twisting device comprises a disc which is rotatable about an axis situated in the plane of the binding, the disc being arranged to seize and twist the wires together as the disc rotates and, for seizing the wires, having a single finger which projects outwards from the axis of rotation of the disc and is forwardly curved in the direction of rotation of the disc, the inner edge of the finger leading to a slit which extends through the disc up to the centre of rotation thereof, the slit tapering in a region adjacent the centre of rotation to a width which only just exceeds the thickness of one wire.

Owing to the provision of only a single finger on the disc, the range of angular positions in which the disc may be stopped at the end of a twisting operation is increased from about 30° in the known device to about 180° in the device in accordance with the invention, so that the disadvantages previously explained in connection with the stopping position for the known device are reliably avoided. A precisely defined distance between the two wires to be twisted together is also no longer necessary, so that this cause of trouble is also removed. Owing to the wires being held close together during the twisting operation at the centre of the disc, a twisted connection is produced having a largely uniform pitch and thus a constant strength throughout the length of the connection. Moreover, the wires lie closely together at the position of subsequent cutting, thus considerably reducing the risk of injury to persons handling the bound bales.

The invention also consists, according to another of its aspects in a method of operating the binding device of a baling press in accordance with the invention in order to move the loop of the one wire out of the needle, wherein the needle during the last turn of the disc at the end of a twisting operation is moved towards the disc and the subsequent rotation of the disc swings the loop out of the path of the needle, after which the disc is brought to a standstill.

An example of a baling press having a binding device in accordance with the invention, and of a method of operating the device will now be described with reference to the accompanying drawings, in which.

Figure 1:
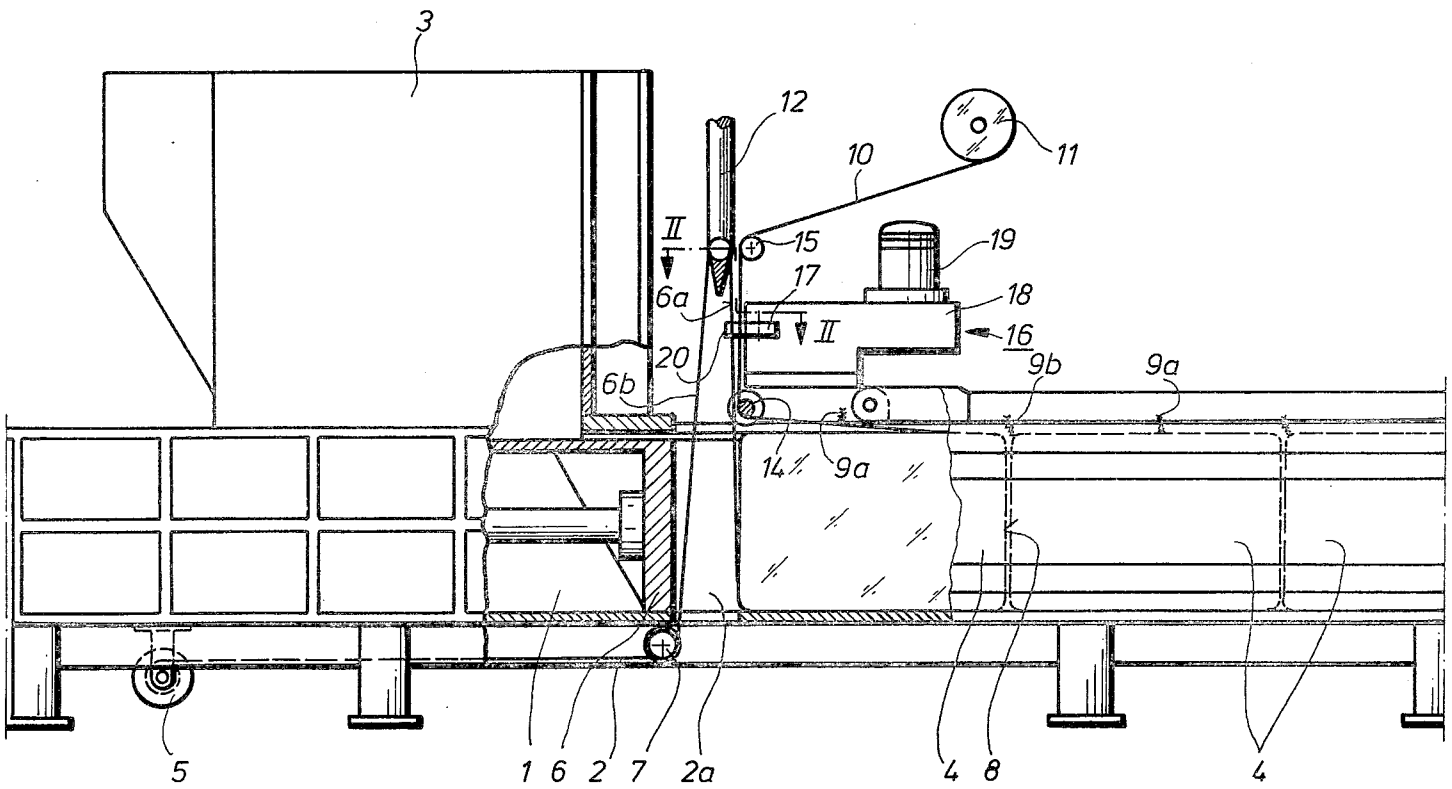
FIG. 1 is a diagrammatic side view of the press with the binding device.
Figure 7:
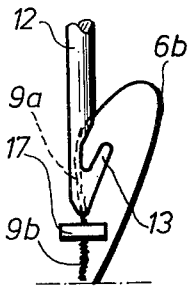

The baling press comprises a pressing plunger 2, which is operated by a drive not shown, and reciprocates in a pressing channel 1 of rectangular cross-section. When the pressing plunger is retracted, material to be pressed into bales is supplied to the channel 1 through a filler shaft 3 which leads from above. Several working strokes of the plunger are necessary for producing each bale. In the pressing channel 1 as shown in FIG. 1, there are already three pressed bales 4 of waste paper, of which the central and right-hand bales have already been bound with wire, while the left-hand bale is just about to be bound. From a lower storage reel 5, a first wire 6 passes beneath the pressing channel 1 via a guide roller 7 and around a forward end face 8 of the bale just about to be bound and is connected at the upper face of this bale, at a twist connection 9*a*, the formation of which will be described in more detail below, to a second wire 10, which is drawn from an upper storage reel 11. A binding needle 12, which is reciprocable up and down along its longitudinal axis and has a hook 13 (FIG. 7), is moved at the desired instant transversely through the pressing channel 1 and through a groove 2*a* formed in the front face of the pressing plunger 2, and lifts from the lower wire 6 a wire loop 6*a*, 6*b* above the top of the pressing channel, so that the length of wire 6*a* which forms a closure length of the bale binding is situated closely adjacent the upper wire 10, which is held taut vertically between two guide rollers 14, 15. A twisting and cutting device 16 is mounted on the top of the channel 1. In the twisting and cutting device, a disc 17 which serves to seize and twist together the wires 6*a* and 10, is mounted so that it is rotatable about a vertical axis on a housing 18 and is driven by means of a motor 19 through gearing in the housing 18.

Figure 2:
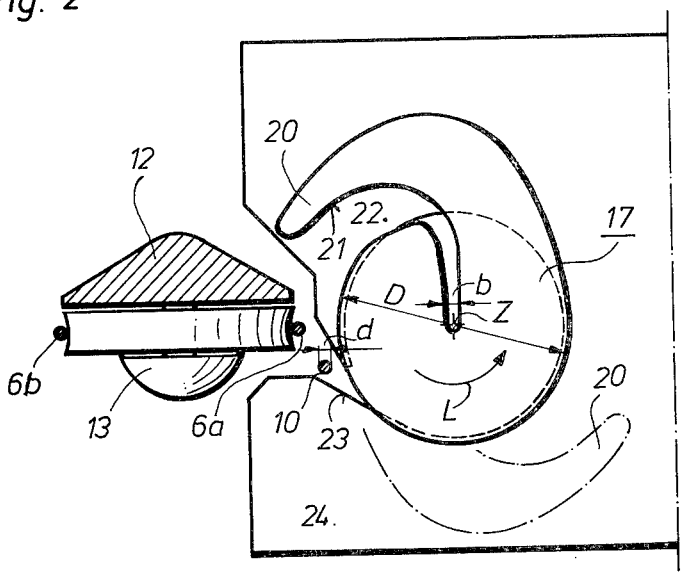
FIG. 2 is a section to a larger scale through the binding device as seen in the direction of the arrows on the line II—II in FIG. 1.

As shown in FIG. 2, the disc 17 has a single finger 20, which projects laterally beyond the disc circumference which is of a diameter D and is curved in the direction of rotation L of the disc in order to seize the stretched wires 6*a* and 10. An inner edge 21 of the finger 20 leads into a slit 22, which continues as far as the centre of rotation Z of the disc 17. The slit 22 has adjacent the centre of the disc 17, a width b, which is only slightly larger than the thickness d of either one of the wires to be twisted together, so that the wires 6*a* and 10 are held firmly against rotation in the slit 22 of the disc 17 during the twisting operation. The shape of the operative edge 21 of the finger 20 and of a guide surface 23 of a stationary plate 24 associated with the finger are such that these two edges form an angle of approximately 90° as they pass over one another. As a result, jamming of the wires between the relatively moving surfaces during the pulling in of the wire is prevented.

Figure 3:
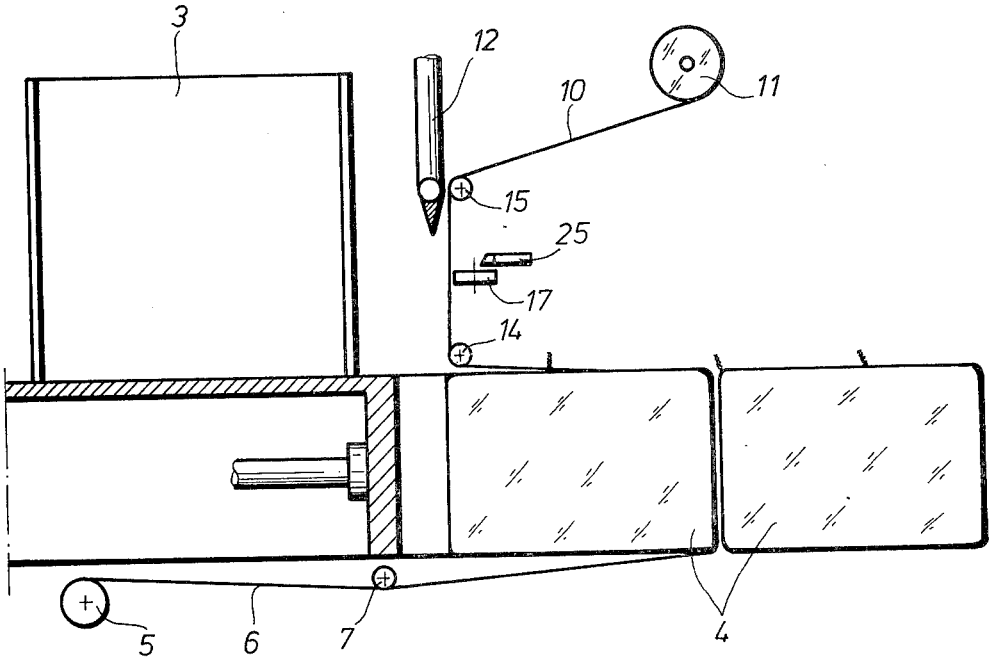
FIGS. 3 to 6 and 8 are diagrammatic side views of the binding device at various stages of operation; and, FIG. 7 is a view of the binding needle of the device as seen in the direction of the arrow VII in FIG. 6.
Figure 4:
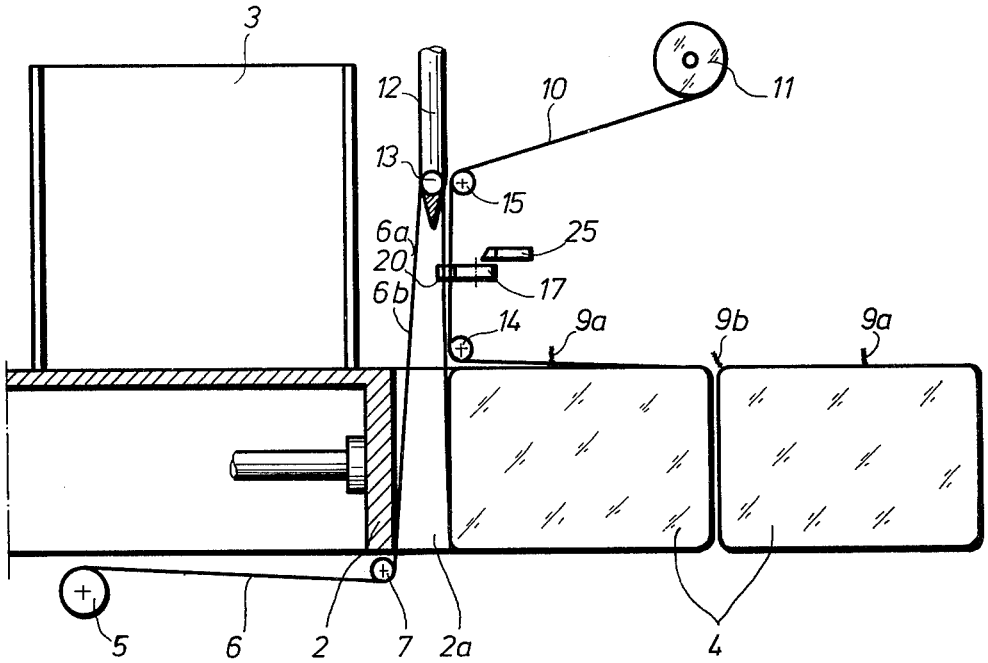

The above-described device operates as follows:

When, as shown in FIG. 3, the left-hand bale 4 has just been pressed, the pressing plunger 2 is in the right-hand limiting position, so that the groove 2*a* formed in the front face of the pressing plunger is in alignment with the binding needle 12. In the stage of operation shown in FIG. 4, the binding needle 12 has meantime executed a downward and upward movement and the hook 13 has seized the lower wire 6 and formed a wire loop, consisting of the lengths of wire 6*a*, 6*b*. The disc 17 has already rotated so far that the wires to be twisted together have just come into contact with the inner edge 21 of the finger 20.

Figure 5:
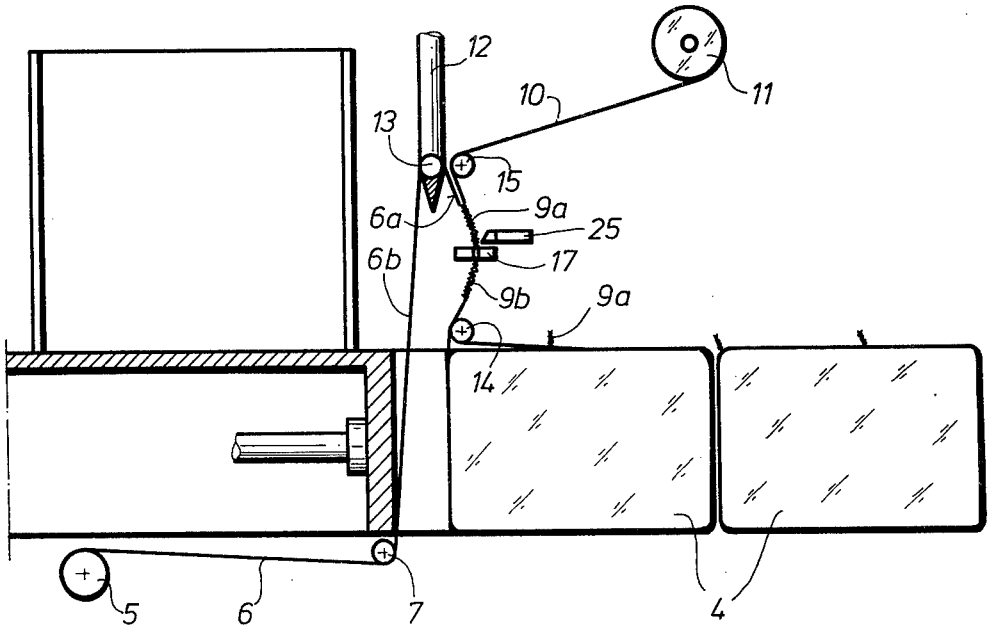
Figure 6:
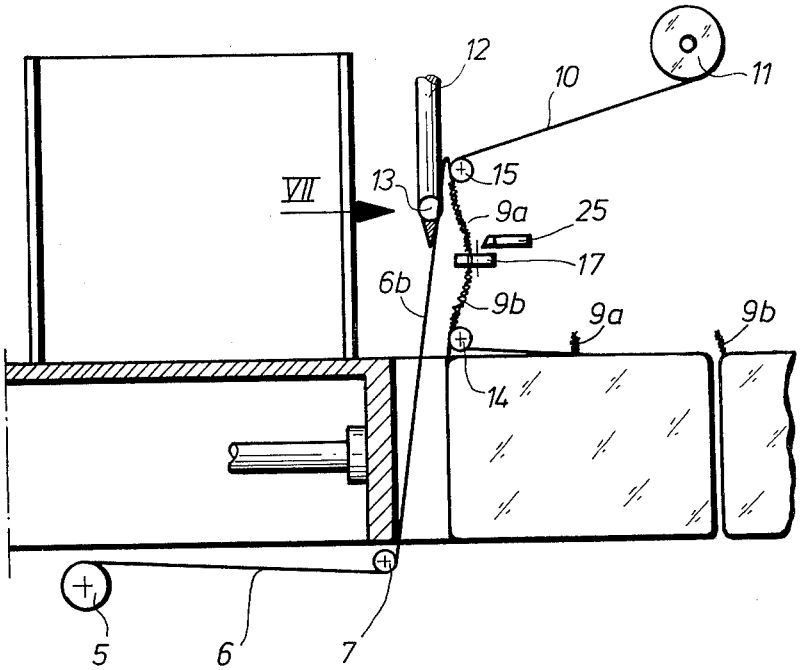

In FIG. 5, the twisting operation has already proceeded to some extent but is not yet quite complete. In this stage of operation, the binding needle 12 is lowered during the last rotation of the disc 17 into the position shown in FIG. 6, so that the wire loop is released from the hook 13. As a result, the wire follows the remaining position of the disc 17 and is swung out of the plane of the drawing (FIG. 5), so that it reaches a position shown in FIGS. 6 and 7 out of the upward path of the binding needle 12. The twisting operation is thus completed. Above the disc 17, a twist connection 9*a* has been formed, and this maintains the connection between the upper wire 10 and lower wire 6. A twist connection 9*b* formed below the disc closes the band of wire around the left-hand waste paper bale 4.

Figure 8:
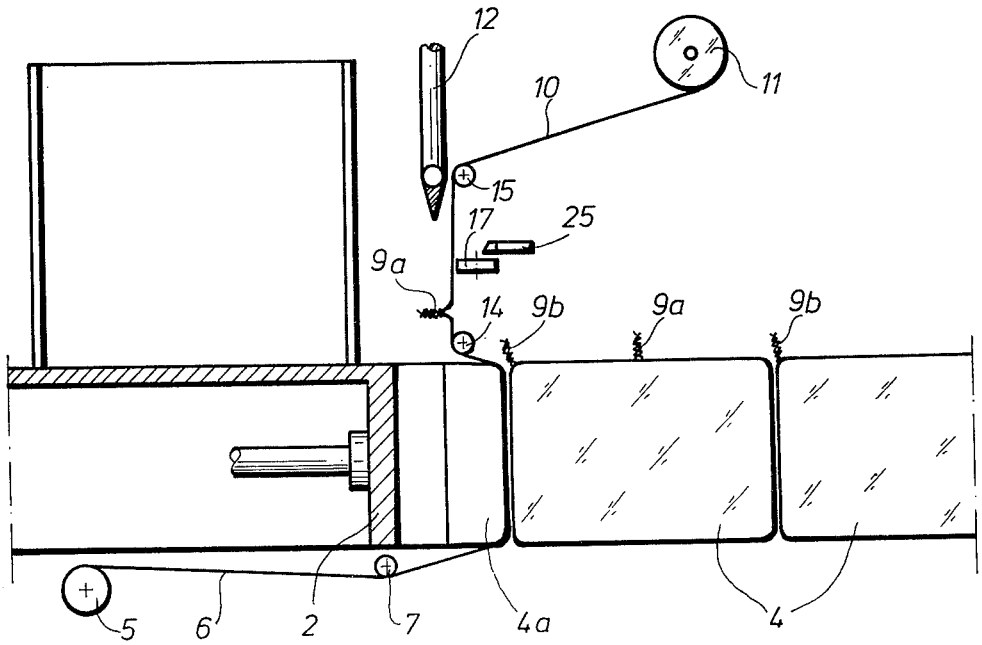

In the stage of operation shown in FIG. 8, the binding needle 12, which is freed of the wire loop, has returned into its starting position. A cutting device 25 has severed the wires between the twist connections 9*a*, 9*b* above the disc 17 and the pressing plunger 2 has already executed one subsequent working stroke and has pressed a first slab of material 4*a* against the wire 6 which is held across the pressing channel, in order to form a new bale. The disc 17, during the forming of the bale, is held in a position in which the finger 20 is located as seen in FIG. 2, in an "inactive" range between the position shown in chain-dotted lines and that shown in full lines.

We claim:

1. In a baling press for pressing and baling compressible material, said press comprising a pressing channel, a pressing plunger in said channel, means for reciprocating said pressing plunger in said channel to compress material fed to said channel and form a succession of pressed bales in said channel, and a binding device for binding said bales pressed in said channel, said binding device including holders for holding two separate rolls of binding wire, a binding needle, means for moving said needle across said channel to form a loop in the wire from one of said rolls, twisting means for forming adjacent first and second twist connections between a portion of said wire in said loop and wire from the other of said rolls, said wires together forming a band surrounding one of said pressed bales in said channel, and cutting means for severing said two wires between said two twist connections, the improvement wherein said twisting means comprises a disc, means mounting said disc for rotation about an axis situated in the plane of said band, and means for rotating said disc, said disc comprising a single finger which projects outwards from said axis of rotation of said disc and is forwardly curved in the direction of rotation of said disc, means defining a slit in said disc, said finger including an inner edge which leads into said slit and said slit extending through said disc up to said centre of rotation thereof, and said slit tapering adjacent said centre of rotation to a width which only just exceeds the thickness of either one of said wires.

2. A baling press as claimed in claim 1, further comprising means for stopping said disc after a last turn thereof at the end of a twisting operation, and means for moving said needle towards said disc during said last turn of said disc, whereby said movement of said needle moves said loop of said one wire out of said needle and subsequent rotation of said disc in said last turn thereof swings said loop out of the path of movement of said needle.

3. A method of operating a binding device in a baling press for pressing and baling compressible material, said binding device including a binding needle which is moved to form a loop in a first wire extending partially around a bale to be bound, twisting means for forming adjacent first and second twist connections between a portion of said first wire in said loop and a portion of a second wire which extends around the remainder of said bale to complete said binding, said twisting means comprising a disc which is rotated about an axis situated in the plane of said binding, said disc, upon rotation thereof, being operative to seize said wires and form said first and second twist connections, said method comprising the steps of rotating said disc through a final turn to complete said twist connections; moving said needle towards said disc during said final turn and before the end thereof to release said loop from said needle; and completing said final turn of said disc to swing said loop out of the path of movement of said needle.

* * * * *